United States Patent [19]

Loper et al.

[11] Patent Number: 4,783,941

[45] Date of Patent: Nov. 15, 1988

[54] PREFABRICATED PANEL FOR BUILDING WALL CONSTRUCTION

[76] Inventors: William Loper, 1683 E. Cedar, Denver, Colo. 80209; Thomas Obermeier, 1700 Forest Pkwy., Denver, Colo. 80220

[21] Appl. No.: 923,410

[22] Filed: Oct. 27, 1986

[51] Int. Cl.[4] ..... E04H 1/00

[52] U.S. Cl. ..... 52/235; 52/385; 52/509; 52/573

[58] Field of Search ..... 52/235, 385, 403, 674, 52/573, 509

[56] References Cited

U.S. PATENT DOCUMENTS

| | | | |
|---|---|---|---|
| 3,478,480 | 11/1969 | Swenson | 52/235 X |
| 4,107,887 | 8/1978 | Wendt | 52/235 X |
| 4,506,482 | 3/1985 | Pracht et al. | 52/235 |
| 4,519,173 | 5/1985 | Roberts | 52/235 |

FOREIGN PATENT DOCUMENTS

| | | | |
|---|---|---|---|
| 1289289 | 2/1969 | Fed. Rep. of Germany | 52/235 |
| 1959835 | 6/1971 | Fed. Rep. of Germany | 52/235 |
| 1293557 | 4/1962 | France | 52/235 |
| 725690 | 11/1966 | Italy | 52/235 |
| 7009857 | 1/1971 | Netherlands | 52/235 |
| 46561 | 3/1961 | Poland | 52/235 |

OTHER PUBLICATIONS

"Preassembled Indiana Limestone Facade", *Engineers Notebook*, Bedford, Indiana, Jan. 1973.

*Primary Examiner*—Carl D. Friedman

*Attorney, Agent, or Firm*—Brooks & Kushman

[57] ABSTRACT

In a prefabricated building wall panel a rigid supporting frame is covered on one face by masonry or ceramic cladding, the cladding being held to the supporting frame by a composite fastener system comprising rigid supports underlying the cladding to carry the dead loading thereof with resilient means adhesively securing the cladding to the support frame to resist live loading thereof.

18 Claims, 4 Drawing Sheets

PREFABRICATED PANEL FOR BUILDING WALL CONSTRUCTION

FIELD OF INVENTION

This invention relates to the field of building wall construction and more particularly to construction of building walls using prefabricated panels covered with a plurality of fascia panels or tiles resiliently mounted to the panel supporting structure.

BACKGROUND OF THE INVENTION

U.S. Pat. No. 4,506,482 discloses a prefabricated wall panel in which a rigid support structure is covered on one side with a plurality of fascia panels, such as tiles, resiliently secured thereto. A plurality of such prefabricated wall panels are fastened to a building's framework to form an exterior wall thereof. The fascia panels or tiles are supported solely by their resilient connection to withstand both the dead load (weight of the tiles) as well as the live load (positive or negative wind pressure loads). While such arrangement is satisfactory in many cases, on occasion it becomes desirable to provide for a rigid or positive support for the tiles.

SUMMARY OF THE INVENTION

The present invention provides a composite fastening arrangement for securing the fascia panels or tiles to the supporting structure of the wall panel. The resilient connection disclosed in U.S. Pat. No. 4,506,482 is utilized as the primary support for resisting lateral loading (herein termed live loading) of the tiles while rigid support means underlie the fascia panels or tiles and primarily carry the weight thereof (herein termed the dead loading). The cooperation between the two types of connection enable relative movement between the tiles and underlying support structure in response to sudden pressure changes, temperature changes, seismic disturbances, stresses induced during transportation and erection of the prefabricated panels, and the like, while providing a rigid support for the dead loading, without damaging the integrity of the connection.

In the various embodiments of the invention disclosed herein, the fascia panels or tiles are secured to the underlying supporting frame by a silicone adhesive which provides a resilient connection therebetween. Rigid supports are secured to the underlying frame for carrying the dead weight of the tiles. Thus the weight of the tiles is carried by rigid supports secured to the frame of the wall panel while the live load is carried by a resilient connection provided by the silicone. The rigid supports are designed to allow relative movement between the fascia panels and the support structure.

In an optional alternative, the rigid supports may be shaped to cooperate with kerfs or the like in the tiles to provide a secondary support to the resilient connection which may be useful in complying with building codes requiring a connection between the tiles and supporting framework which would survive temperatures that could destroy the silicone bond.

BRIEF DESCRIPTION OF PREFERRED EMBODIMENTS

U.S. Pat. No. 4,506,482, which is incorporated herein by reference shows in FIG. 1, a building wall made up of a plurality of prefabricated panel sections which are secured to the building framework. Each of the panel sections has a plurality of fascia sheets, or tiles, which are adhesively secured to an underlying rigid support structure. The present disclosure shows improvements in these panel sections.

Figure 12:
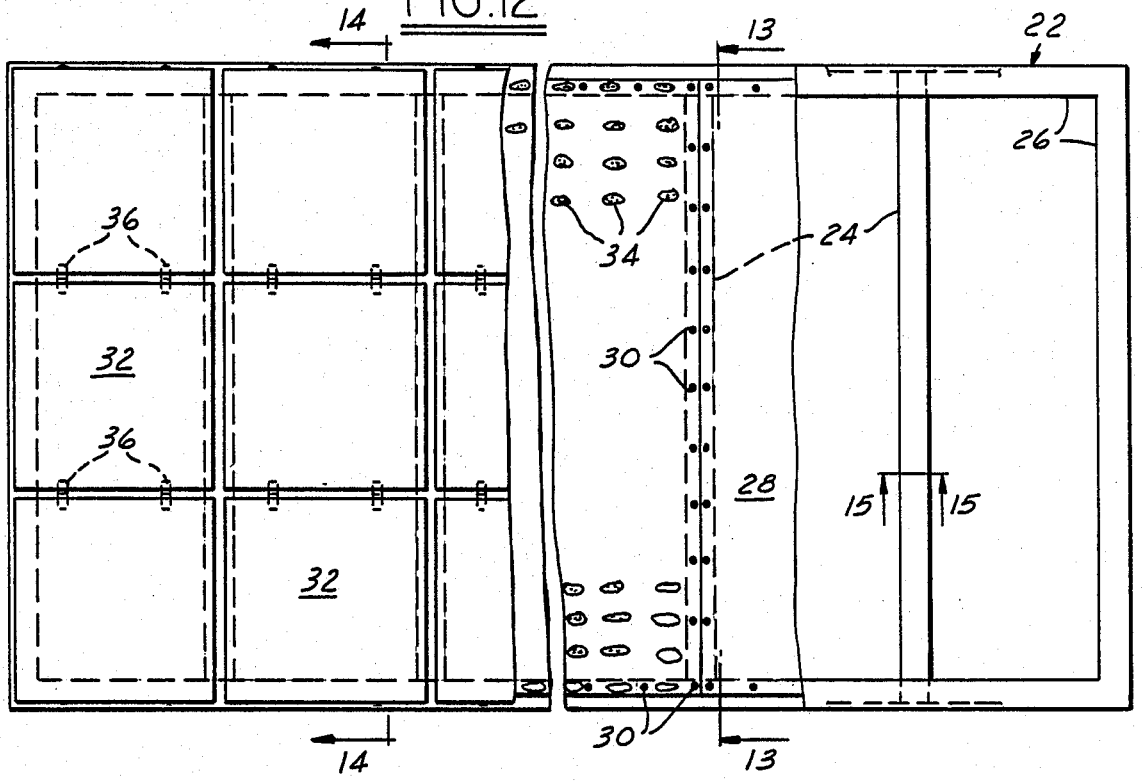
FIG. 12 is a front elevation of a modified form of a building wall panel with parts broken away, or removed, for clarity.

In FIG. 12 of this application the rigid support structure of a panel section 22 is shown as comprising a structural frame consisting of vertically arranged galvanized steel studs 24 welded at the ends to a perimeter track 26 of 18-gauge galvanized steel. Flat galvanized steel sheets or decking 28 is secured to this structural frame either by screws or rivets 30 and/or by spot-welding so that the flat sheets 28 serve to stablize and reinforce the structural frame. The C-studs 24 may be lightened by having cut-outs 32 which are conventional.

Overlying one side of the rigid support structure of the panel section 22 are a plurality of fascia sheets or tiles 32, sometimes also referred to as cladding. The tiles are formed of materials selected from the group consisting of ceramics and masonry. For example granite, marble and ceramic tiles are available in many different sizes, colors and textures.

Figure 14:
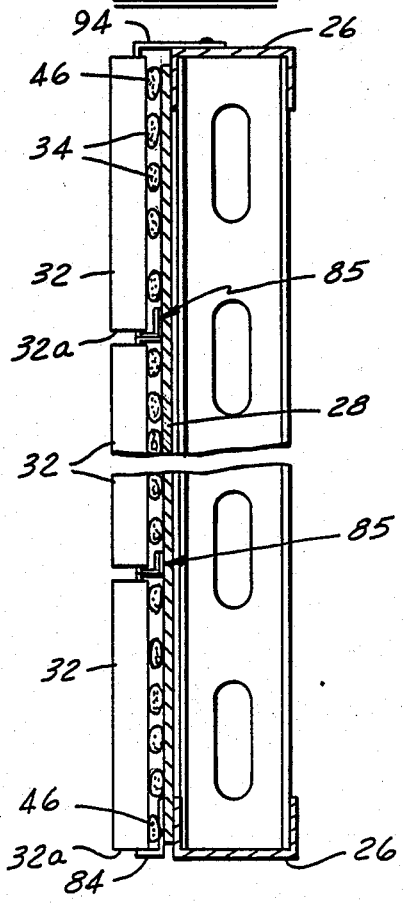
FIG. 14 is a cross-sectional view taken on the line 14—14 of FIG. 12.
Figure 15:
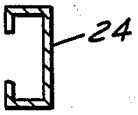
FIG. 15 is a cross-sectional view taken on the line 15—15 of FIG. 12.

Such cladding is secured to the rigid support structure of the panel section 22 by a composite fastening system comprising a resilient structural adhesive 34 which is intended to support the tiles against live loading, and rigid supporting means 36 which is intended to support the cladding against the dead load. Live loads are created by positive or negative pressures within or outside the building such as may arise from the influence of wind around the building inducing positive or negative pressures on the cladding. The adhesive bond is created by depositing dabs or lumps 34 in the form of short beads of the adhesive on the decking 28 at regular intervals as best shown in FIGS. 12 and 14 and thereafter laying the tiles over the decking in the desired pattern and pressing them against the adhesive to force it into good contact with the cladding. Upon cure the adhesive will resist lateraly imposed live loads on the cladding. Because the dabs of adhesive have been deposited over the entire face of the decking, the tiles are securely anchored to the structural frame.

Figure 7:
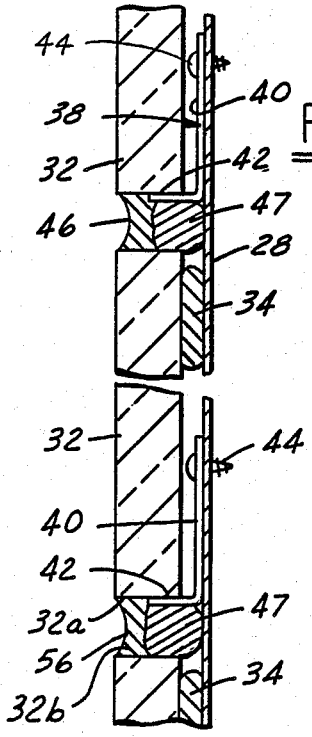
FIG. 7 is a fragmentary vertical cross-sectional view through a modified form of panel construction illustrating the use of a third form of fastener useful in resisting only dead loads.

To support the dead load of the cladding 32, rigid support means are provided which engage beneath the lower edge 32*a* of the tiles. Such rigid support means may take various forms. One form is shown in FIG. 7, where the supports are in the form of L-shaped clips 38 having a back portion 40 and a lip portion 42. A screw fastener 44 extends through the back portion 40 and into the deck 28. Spot welding, riveting or the like may be used in lieu of the screws 44. The tiles rest on the lip 42 of the fasteners carrying the weight or dead load of the tiles. The lip 42 permits movement of the tiles toward and away from the decking 28 but prevents downward movement. A suitable caulk 56 is deposited between the adjacent edges 32*a* and 32*b* to fill the gap and cover the L-shaped clips. A backer rod 47 comprising a polyethylene foam strip is disposed in the gap between adjacent edges 32*a* and 32*b* of the tiles to provide a base against which the caulk 56 may lie.

Figure 8:
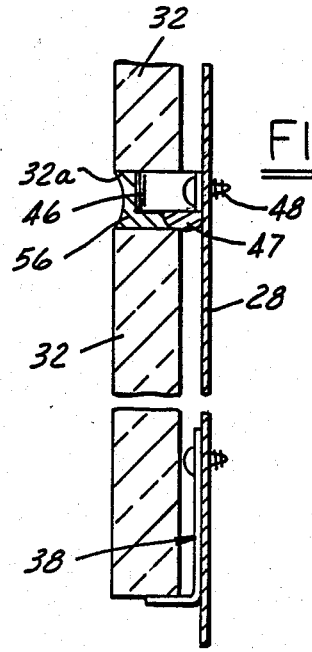
FIG. 8 is a view similar to view 7 but showing a fourth form of fastener for resisting dead loads.
Figure 9:
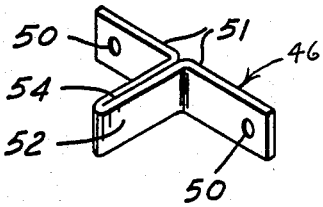
FIG. 9 is a perspective view of one of the fasteners shown in FIG. 8.

A second form of rigid support means is shown in FIGS. 8 and 9 wherein a strip of steel is folded upon itself into a T-shape to form a clip 46 best shown in FIG. 9. The clip includes a head portion 51 and a shank portion 52. The clip may be secured by fasteners 48 extending through holes 50 and into the decking 28 as shown in FIG. 8. The shank 52 provides a smooth edge 54 for underlying edge 32*a* of the tiles and permitting slight movement of the tiles toward and away from the decking 28. The shank 52 of clip 46 is disclosed between the upper and lower edges of adjacent tiles and is covered and concealed by caulk 56. Along the lower edge of a panel section the L-shaped clip 38 is used as shown in FIG. 8 to support the dead load of the lowermost row of the cladding.

Figure 10:
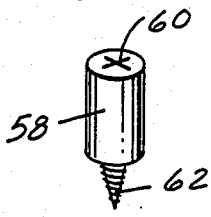
FIGS. 10 and 11 show further forms of fasteners for resisting dead loads in the panel construction.
Figure 11:
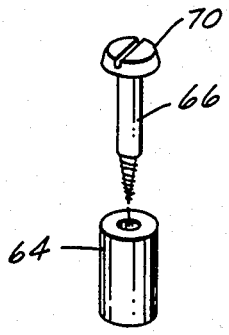

A third form of the rigid supporting means is shown in FIGS. 10 and 11. In FIG. 10 a threaded fastener is provided with a cylindrical shank portion 58, driving tool receiving notches 60, and a threaded point 62 for screw threaded reception in the metal deck 28. The cylindrical shank 58 provides a smooth bearing surface to underlie the lower edge 32*a* of the tile. As in the case of the clips 38 and 46, two of these fasteners, arranged in spaced apart relation (as at 36 in FIG. 12), would underlie the lower edge of each tile. The embodiment of FIG. 11 is similar to FIG. 10 but the support is formed of two pieces: a cylindrical sleeve 64 and a screw 66. The latter has a threaded point 68 at one end and a screw driver slotted head 70 at the other end. Functionally the embodiments of FIG. 10 and 11 are substantially identical.

Figure 1:
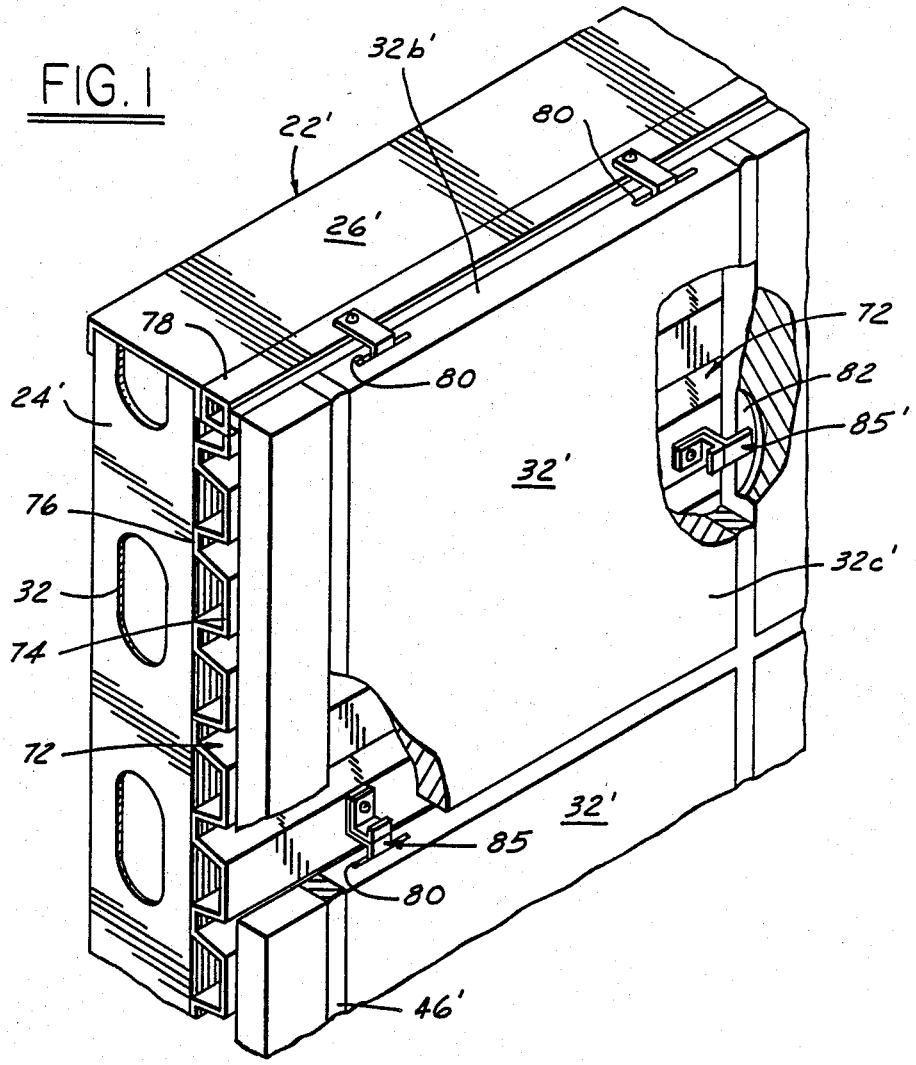
FIG. 1 is a perspective fragmentary view, with portions broken out to show details of attachment, of a building wall panel embodying the invention.
Figure 2:
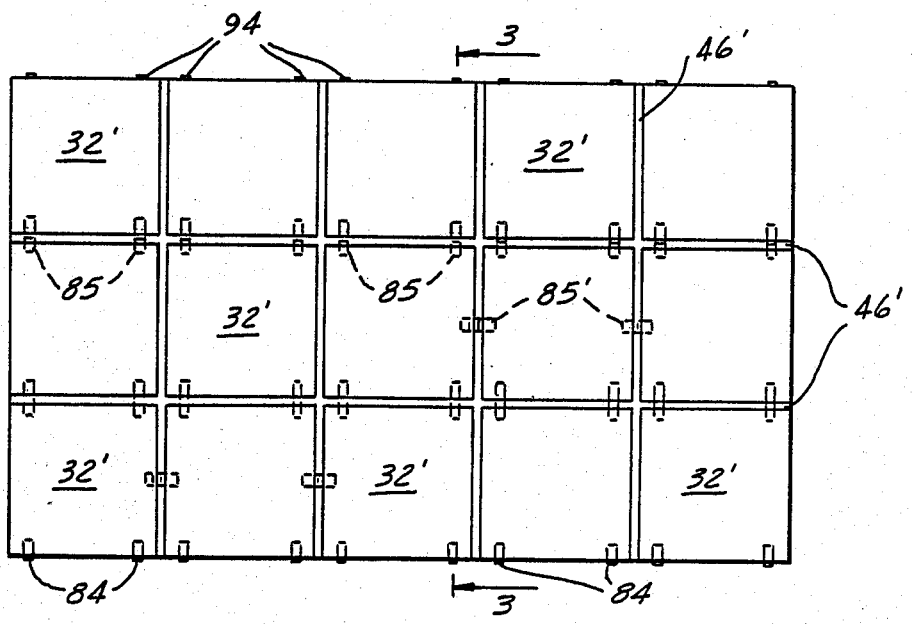
FIG. 2 is a front elevation of a prefabricated building wall panel embodying the invention.
Figure 3:
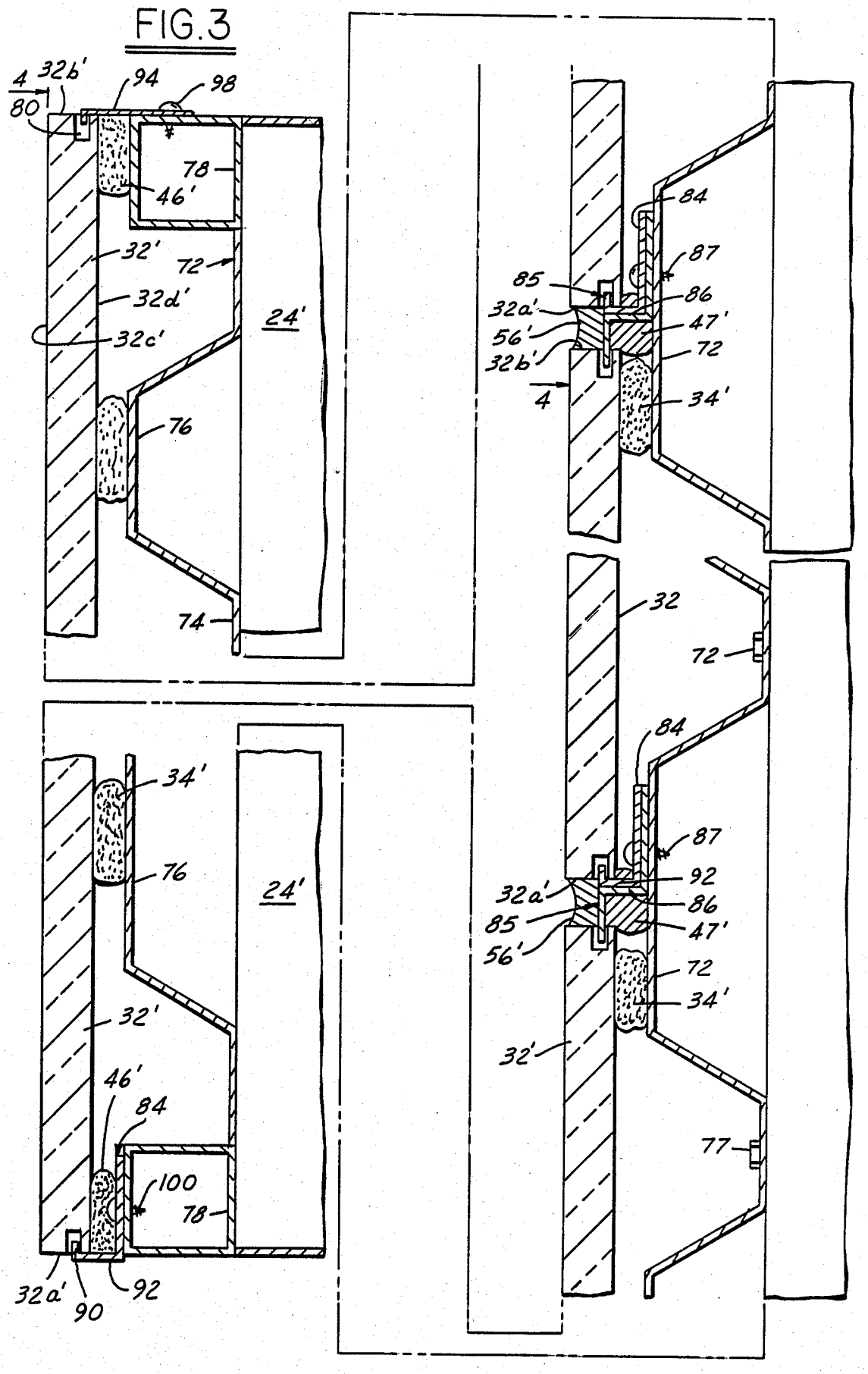
FIG. 3 is a cross-sectional view taken on the line 3—3 of FIG. 2 showing fasteners useful in resisting both live and dead loads in the panel construction.
Figure 4:
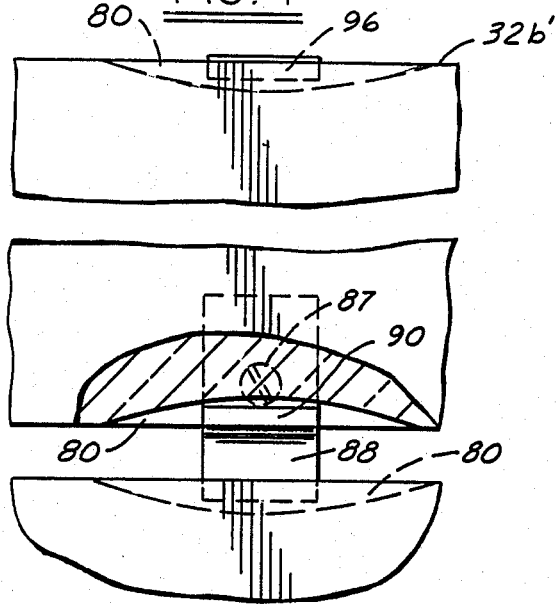
FIG. 4 is a fragmentary front elevation partially in section looking in the direction and at the areas shown by arrows 4 in FIG. 3 and further depicting the fasteners shown in FIG. 3.
Figure 5:
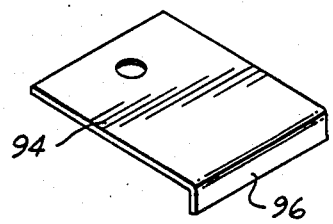
FIG. 5 is a perspective view of one of the fasteners of FIG. 3 and 4.
Figure 6:
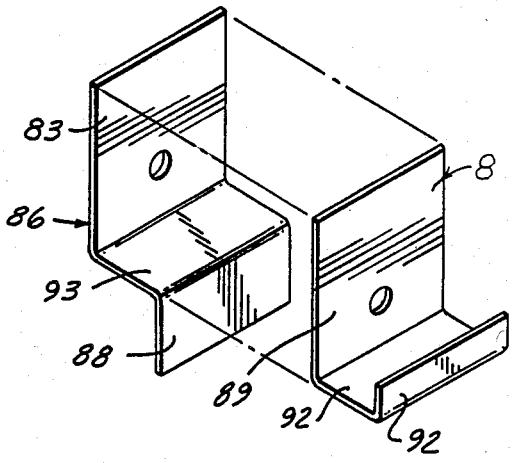
FIG. 6 is a perspective exploded view of another fastener of FIG. 3 and 4.
Figure 13:
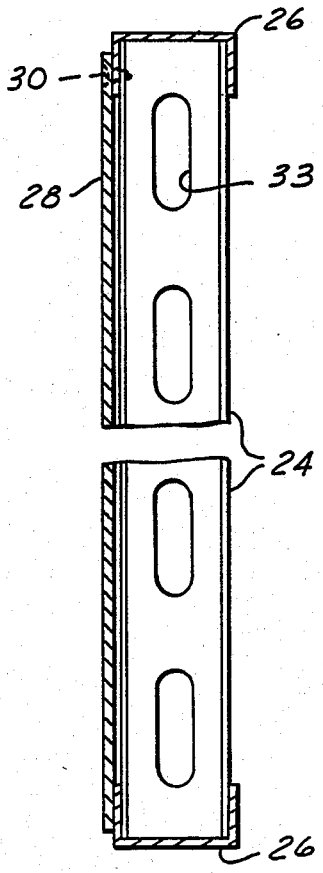
FIG. 13 is a cross-sectional view taken on the line 13—13 of FIG. 12.

In FIGS. 4–6 a further embodiment of the rigid support is shown. As such is shown only generally in conjunction with the panel section of FIGS. 12–14, but in detail with the form of panel section disclosed in FIGS. 1—3 inclusive, such latter panel section will be described first. Reference numbers designating structure generally corresponding to that previously described are primed. In FIGS. 1–3, a rigid support structure comprises vertical studs 24' of 6", 16-gauge galvanized steel, welded to a perimeter frame 26' formed of 18-gauge galvanized steel track. One side of the frame is covered by a steel deck 72 of 22-gauge galvanized steel. The deck is formed having a series of parallel ridges 74 and groves 76 referred to in the trade as hats and valleys, respectively. The valleys are attached as by welding, riveting or screwing 77 to the rigid support structure such as studs 24'. The sides and ends of the deck are closed at the perimeter track 26' by an edge closure or tube 78 which is welded or otherwise secured to the decking 72 and the track 26'. The cladding is attached to the deck 72 using a silicone based adhesive as described in U.S. Pat. No. 4,506,482 and in addition by rigid fasteners hereinafter described, whereby the attachment of the cladding is by a composite attachment system utilizing both rigid and resilient support means. Adhesive dabs or mounds are shown at 34' for securing the cladding against live loading as described previously in connection with FIG. 12.

Each of the tiles 32' has a front face 32*c'* and a rear face 32*d'* and the upper and lower edges 32*a'* and 32*b'* connect such faces. Along the lower edge 32*a'* of each tile, and also along the upper edge 32*b'* of each tile, the edge is provided with kerfs 80 arranged in laterally spaced apart relation and disposed between the front and rear faces 32*c'* and 32*d'*. A similar kerf 82 may be formed in the side edges of each tile. The kerfs may be formed by a circular saw. Preferably 2 kerfs are formed along the upper edge and 2 along the lower edge, and one on each side edge, of each tile. These kerfs are intended to receive retainers as shown in FIG. 1, 3 and 4. The retainers 85 shown in FIG. 1 are shown in detail in FIG. 6. Each retainer comprises a J-shaped clip 84 nested against a Z-shaped clip 86 with apertures in each aligned to receive a screw, rivet or the like 87 to secure the retainer to the deck 72. Clip 86 has a back portion 83 and a flange portion 93 terminating in a lip 88. Clip 84 has a back portion 89 and flange portion 92 terminating in a lip 90. When the clips are nested as best shown in FIGS. 1 and 3, the lip 88 of the Z-clip faces oppositely from the shorter lip 90 of the J-clip, thereby allowing greater latitude in dimensioning of the tiles as the longer lip 88 may be cut off as desired to accomodate variations in the space between tiles. The lips 88 and 90 are received in the kerfs formed in the edges of the tile. The lips 88 and 90 provide a rigid mechanical connection between the underlying rigid framework of the panel section and the tile, thereby augmenting or supplementing the adhesive connection. The juxtaposed flanges 92 and 93 of the clips also serve as a support under the lower edge 32*a'* as shown in FIG. 3 to carry the dead load of the cladding.

In FIG. 5 an L-shaped clip 94 is shown having a lip 96 intended to be received in a kerf 80 along the upper edge 32*b'* of the panel section. A screw or rivit 98 serves to fasten L-clip 94 to the tube 78. Along the lower edge 32*a'* of each panel section, as shown in FIG. 3, a J-clip 84 is fastened to the tube 78 by a similar screw or rivit 100 and the lip 90 is seated in the kerf 80. In the gap between opposed edges 32*a'* and 32*b'*, backer rods 47' may be inserted, and then caulk 56' applied thereover to fill the seam or joint.

FIG. 2 shows the general arrangement of the retainers of FIGS. 5 and 6 in relation to the cladding. Two retainers 85 are arranged spaced apart along the opposed upper and lower edges of each tile while two clips 94 are arranged along the upper edges of the tiles along the upper edge of the panel section. Along the lower edge of the panel section, the J-clips 84 are arranged with one pair of each for each tile. Side clips 85' may be used if desired.

In connection with the rigid framework of FIG. 12 it is to be understood that the cladding 32' of FIGS. 1 and 4 having the kerfs 80 may be used in lieu of cladding 32 and retainers such as 85 and 85', 84 and 94 may also be utilized. Similarly it is to be understood that cladding without kerfs and utilizing the fasteners of FIG. 7–11 inclusive may be substituted for the cladding and fasteners shown in FIGS. 1–3.

To mount the cladding of FIGS. 1–3 on the underlying rigid supporting structure, the J-clips 84 are first secured to the lower tube 78 along the lower edge of the support structure. Dabs 34' of adhesive are then applied to the decking at regular intervals over the face thereof to be covered by the lowermost row of tiles. Starting at either end of such row, the tiles are set in place on the adhesive with the lip 90 of the J-clips received in the kerfs 80 and the lower edge 32' seated on the flange 92. The fasteners 85 are then attached to the metal decks 72 such that the downwardly extending lip 88 is received in the kerf 80. If it is desired that the fasteners 85' at the side edges of each tile be utilized, these are also attached to the decking. The adhesive dabs may then be applied for the next superjacent row, the tiles set in place on the upwardly extending lips 90 and the process repeated until the entire face of the steel deck is covered with the cladding. The L-clips 94 may then be attached to the tube 78 at the upper edge of the panel, and the sides, if desired, the backer rod 74' inserted, and the caulk 56 applied to fill the joint.

Desirably the kerfs 80 have a somewhat greater thickness than that of the lips 88, 90 or 96 so that there is room for slight movement of the cladding toward and away from the decking to allow for thermal expansion and contraction or otherwise allow some accommodation of the cladding and rigid frame structure to the forces of erection and use. Thus the cladding will float slightly in the panel section in response to live loads while being supported by the rigid supporting elements 85 and the J-clips 84.

What is claimed is:

1. In a wall structure for a building having a building framework and a plurality of prefabricated panel sections secured to the building framework to form a wall surface, each panel section comprising:

a rigid support structure for attachment to the building framework and including a rigid deck substantially co-extensive with the support structure;

a plurality of fascia panels overlying said support structure, said fascia panels having opposite front and back faces with the back face opposing the disposed closely adjacent the rigid deck, said panels formed of materials selected from the group consisting of ceramics and masonry;

rigid means for supporting the dead load of said fascia panels on said support structure while permitting relative movement between the fascia panels and support structure;

means distributed across the back face of the panels between such face and the rigid deck for resiliently supporting and distributing the live load of said fascia panels on said support structure; and means for sealing the joints between adjacent edges of the fascia panels.

2. The invention defined by claim 1 wherein said rigid support structure includes a structural frame and a sheet metal deck overlying one side of the frame and rigidly secured thereto.

3. The invention defined by claim 2 wherein said means for rigidly supporting the dead load and said means for resiliently supporting the live load are secured to said sheet metal deck.

4. The invention defined by claim 2 wherein said sheet metal deck comprises a flat sheet.

5. The invention defined by claim 2 wherein said sheet metal deck is formed to provide parallel ridges and grooves.

6. The invention defined by claim 1 wherein upper and lower horizontal edges connect said faces and kerfs are provided in at least the lower of such edges spaced between said faces; and said rigid means comprises retainers on the support structure having flanges underlying the lower horizontal edges of the fascia panels, said flanges having lips received in said kerfs.

7. The invention defined by claim 6 wherein said kerfs have a front to rear dimension exceeding the thickness of said lips permitting limited relative movement of the fascia panels in respect to said rigid support structure under the influence of live loading.

8. The invention defined by claim 6 wherein said kerfs are provided in both the upper and lower horizontal edges and said retainers include a back portion attached to the rigid support structure behind the back faces of the fascia panels and a flange portion extending outwardly from the support structure between adjacent rows of fascia panels and terminating in upwardly and downwardly extending lips received in said kerfs.

9. The invention defined in claim 8 wherein said retainers include a Z-shaped clip and a J-shaped clip nested together to provide a back portion and a flange portion terminating in upwardly and downwardly extending lips received in said kerfs.

10. The invention defined in claim 9 wherein said back portion is secured to the rigid support structure and the kerfs are oversize the lips permitting limited relative movement between the fascia panels and support structure.

11. The invention defined by claim 1 wherein said fascia panels each have upper and lower horizontal edges and said rigid means for supporting the dead load of the fascia panels underlies the lower edges.

12. The invention defined by claim 11 wherein said rigid means for supporting the dead load is secured to the fascia panels to limit movement of the panels away from the support structure under a live load.

13. The invention defined by claim 12 wherein said fascia panels have vertical faces adjacent the upper and lower horizontal edges facing away from said support structure, and said rigid means are secured to such support structure and have portions overlying said vertical faces to limit movement of the fascia panels away from the support structure independently of said means for resiliently supporting the live load.

14. The invention defined by claim 13 wherein said rigid means is secured to said support structure at joints between upper and lower edges of adjacent fascia panels, and said rigid means having portions overlying vertical faces of the fascia panels adjacent such joints.

15. The invention defined by claim 11 wherein said rigid means comprises a T-shaped clip having a head portion and a shank portion with the head portion secured to the rigid support structure and the shank portion underlying the lower edges of the fascia panels and supporting the dead load thereof.

16. The invention defined by claim 11 wherein said retainers comprise an L-shaped clip having a back portion secured to the rigid support structure and a lip portion underlying the lower edges of the fascia panels and supporting the dead loading thereof.

17. The invention defined by claim 11 wherein said rigid means comprises a retainer having a cylindrical shank portion and a screw-threaded end for connection to the rigid support structure with a cylindrical shank underlying the lower edges of the fascia panels and supporting the dead load thereof.

18. The invention defined by claim 17 wherein said shank portion and screw-threaded end are separable elements.

* * * * *

UNITED STATES PATENT AND TRADEMARK OFFICE

CERTIFICATE OF CORRECTION

PATENT NO. : 4,783,941

DATED : November 15, 1988

INVENTOR(S) : WILLIAM LOPER and THOMAS OBERMEIER

It is certified that error appears in the above-identified patent and that said Letters Patent is hereby corrected as shown below:

In the Claims:

Claim 16, Col. 7, line 7, change "loading" to ---load---.

Claim 1, Col. 5, line 55 change the second occurance of the word "the" to ---and---.

Signed and Sealed this

Twenty-eighth Day of March, 1989

*Attest:*

DONALD J. QUIGG

*Attesting Officer*

*Commissioner of Patents and Trademarks*